US006341210B1

(12) United States Patent
Nozawa et al.

(10) Patent No.: US 6,341,210 B1
(45) Date of Patent: Jan. 22, 2002

(54) TONER CARTRIDGE

(75) Inventors: Kenji Nozawa; Masayuki Ainoya; Yoshitaka Fujinuma; Yuichiro Suzuki, all of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/664,065

(22) Filed: Sep. 18, 2000

(30) Foreign Application Priority Data

Sep. 17, 1999 (JP) ..... 11-263350

(51) Int. Cl.[7] ..... G03G 15/08
(52) U.S. Cl. ..... 399/262; 222/DIG. 1
(58) Field of Search ..... 399/262, 120, 399/252, 258; 222/505, DIG. 1, 325

(56) References Cited

U.S. PATENT DOCUMENTS 4,614,286 A * 9/1986 Yamaguchi et al. ..... 222/505
5,392,963 A * 2/1995 Kelly et al. ..... 222/DIG. 1
5,491,542 A * 2/1996 Nagashima et al. ..... 399/106
5,515,143 A * 5/1996 Shiotani ..... 399/106

* cited by examiner

*Primary Examiner*—Quana M. Grainger
*Assistant Examiner*—Hoan Tran
(74) *Attorney, Agent, or Firm*—Sughrue Mion, PLLC

(57) ABSTRACT

A toner cartridge includes a container for containing toner of a volume of 2500 $cm^3$ or more. The container defines an opening portion, a cap is fixed to the opening portion of the container, and the cap defines a first semicircle opening portion. A film covers and seals the first semicircle opening portion of the cap. A shutter is rotatably disposed on the cap and the shutter defines a second semicircle opening portion capable of corresponding to the first semicircle opening portion of the cap, the shutter having a diameter of 70 mm or above.

2 Claims, 9 Drawing Sheets

TONER CARTRIDGE

BACKGROUND OF THE INVENTION

1. Field of the Invention

The present invention relates to a toner cartridge for supplying toner for a developing unit in image forming apparatuses such as a laser printer, a copier and the like.

2. Description of the Related Art

A conventional toner cartridge will be explained with reference to FIGS. 4 to 7. In FIG. 5, toner 2 is stored in a container 1, and a cap 3 is disposed on an opening portion of the container 1, which has an opening portion 3*a* in the shape of a semicircle. A shutter 6 is rotatably attached to an edge of the semicircle opening portion 3*a* of the cap 3, and has an opening portion 6*a* that is substantially the same shape as the opening portion 3*a*. A sponge 5 has substantially the same shape as a face of the shutter 6 facing the cap 3, and defines an opening portion 5*a* having substantially the same shape as the opening portions 3*a* and 6*a*. The sponge 5 is attached to the shutter 6 so that the opening portions 5*a* and 6*a* correspond to each other. The sponge 5 is pressed by the shutter 6 when the shutter 6 is attached to the cap.

When the shutter 6 is closed, the semicircle opening portion 6*a* of the shutter 6 has a reverse phase relation of 180° with respect to the semicircle opening portion 3*a* of the cap. The semicircle opening portion 3*a* of the cap is covered with the sponge 5 and sealed, thereby preventing the toner 2 from leaking. When the toner cartridge is used, the shutter 6 is rotated by 180°. Therefore, as shown in FIGS. 8 and 9, the opening portions 3*a*, 5*a* and 6*a* correspond to each other, thereby supplying the toner 2 from the toner cartridge.

However, in the case of the aforementioned structure, the sponge 5 is merely pressed to seal the opening portion. Therefore, if a volume of the container portion 1 increases, and a diameter of the semicircle opening portion 6*a* is enlarged while a thickness of the shutter 6 is not changed to prevent the toner supply from leaking from the toner cartridge, there arise problems that stiffness of the center seal portion 6*b* of the shutter 6 weakens, and a portion in the vicinity of the center of the shutter 6 is deformed to project upward by reaction of the pressed sponge so that the volume amount of the pressed sponge 5 is reduced from the predetermined amount. Therefore, the seal efficiency is deteriorated, and the toner is leaked from the toner cartridge due to vibrations, temperature changes, atmosphere changes, and the like, when the toner cartridge is transported.

On the other hand, if the volume amount of the pressed sponge is increased on order to securely seal the opening portion, friction resistance of the sponge 5 increases. Therefore, a torque for rotating the shutter 6 also increases, which results in that the shutter 6 is difficult to operate. Moreover, if the toner cartridge has a structure with a high stiffness not to deform the shutter 6, the thickness of the shutter increases, thereby enlarging the cartridge itself.

SUMMARY OF THE INVENTION

An object of the present invention is to provide a toner cartridge in which toner is not leaked even if the volume of the toner cartridge increases without the thickness of a shutter being increased.

According to the present invention, there is provided a toner cartridge comprising:

a container for containing toner of a volume of 2500 $cm^3$ or more, the container defining an opening portion;

a cap fixed to the opening portion of the container, the cap defining a first semicircle opening portion;

a film covering and sealing the first semicircle opening portion of the cap; and a shutter rotatably disposed on the cap; the shutter defining a second semicircle opening portion capable of corresponding to the first semicircle opening portion of the cap, the shutter having a diameter of 70 mm or above.

The toner cartridge may be made, wherein the film is allowed to be peeled off the cap with the shutter closed.

DETAILED DESCRIPTION OF THE PRESENT INVENTION

A preferred embodiment of the present invention will be described in detail with reference to the accompanying drawings.

Figure 1:
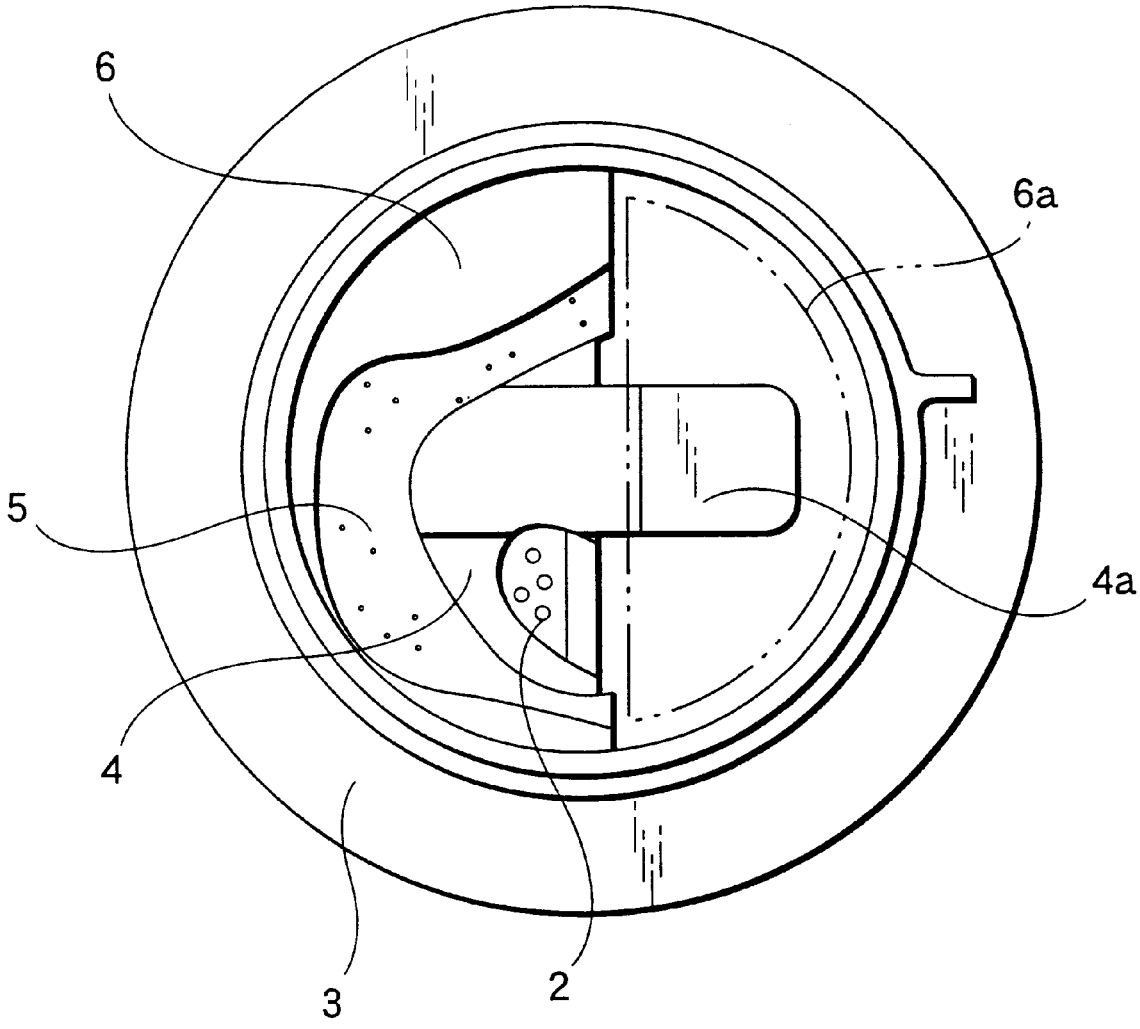
FIG. 1 is a top view showing an embodiment of a toner cartridge of the present invention.
Figure 2:
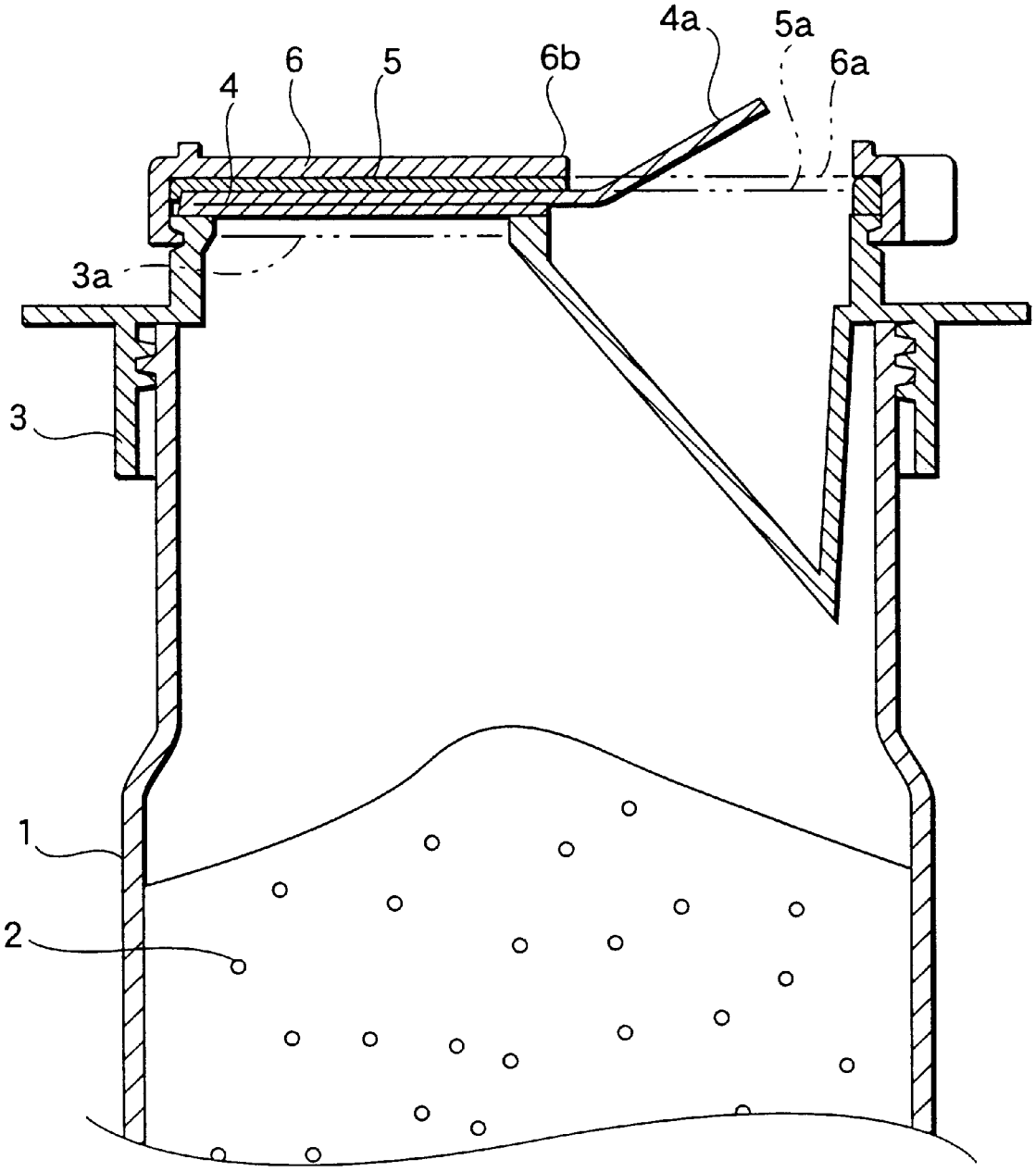
FIG. 2 is a side sectional view showing the embodiment of the toner cartridge of the present invention.
Figure 3:
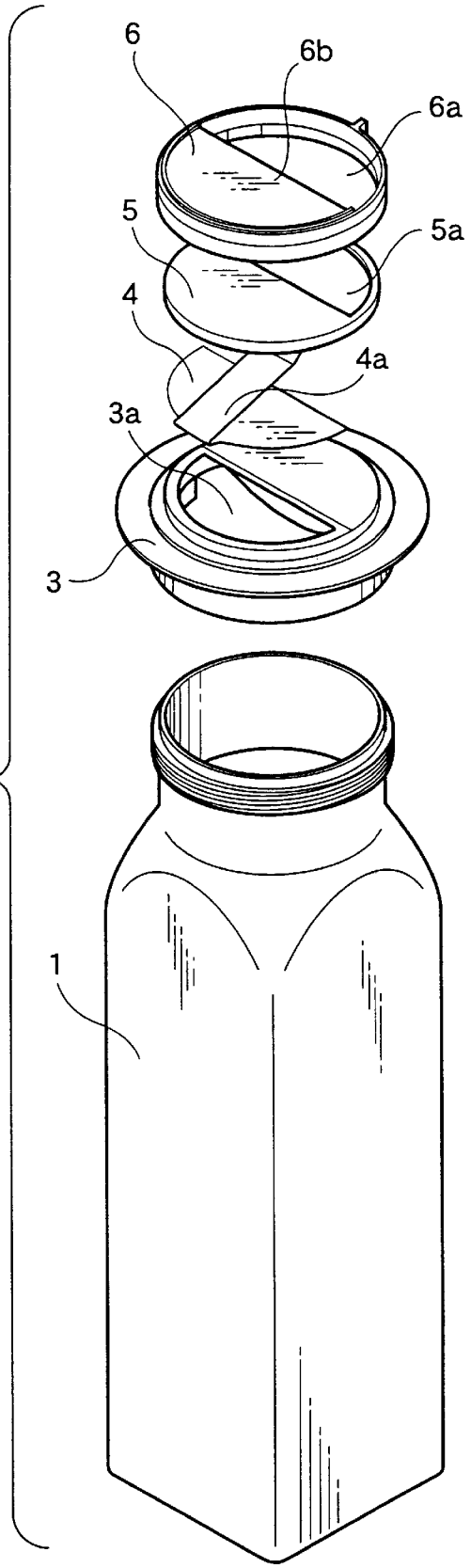
FIG. 3 is an oblique view showing the toner cartridge of the present invention.
Figure 4:
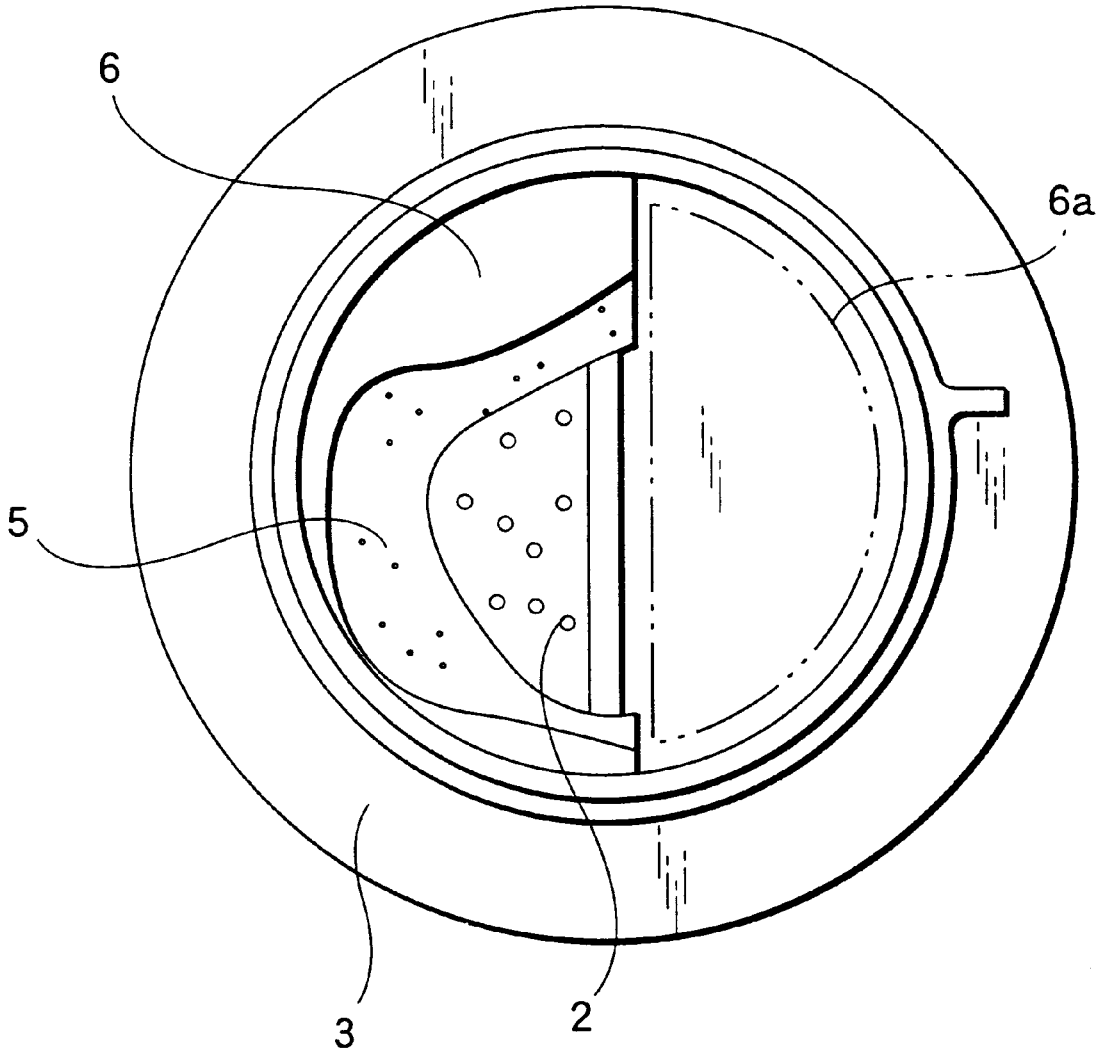
FIG.4 PRIOR ART
FIG. 4 is a top view showing a conventional toner cartridge.
Figure 5:
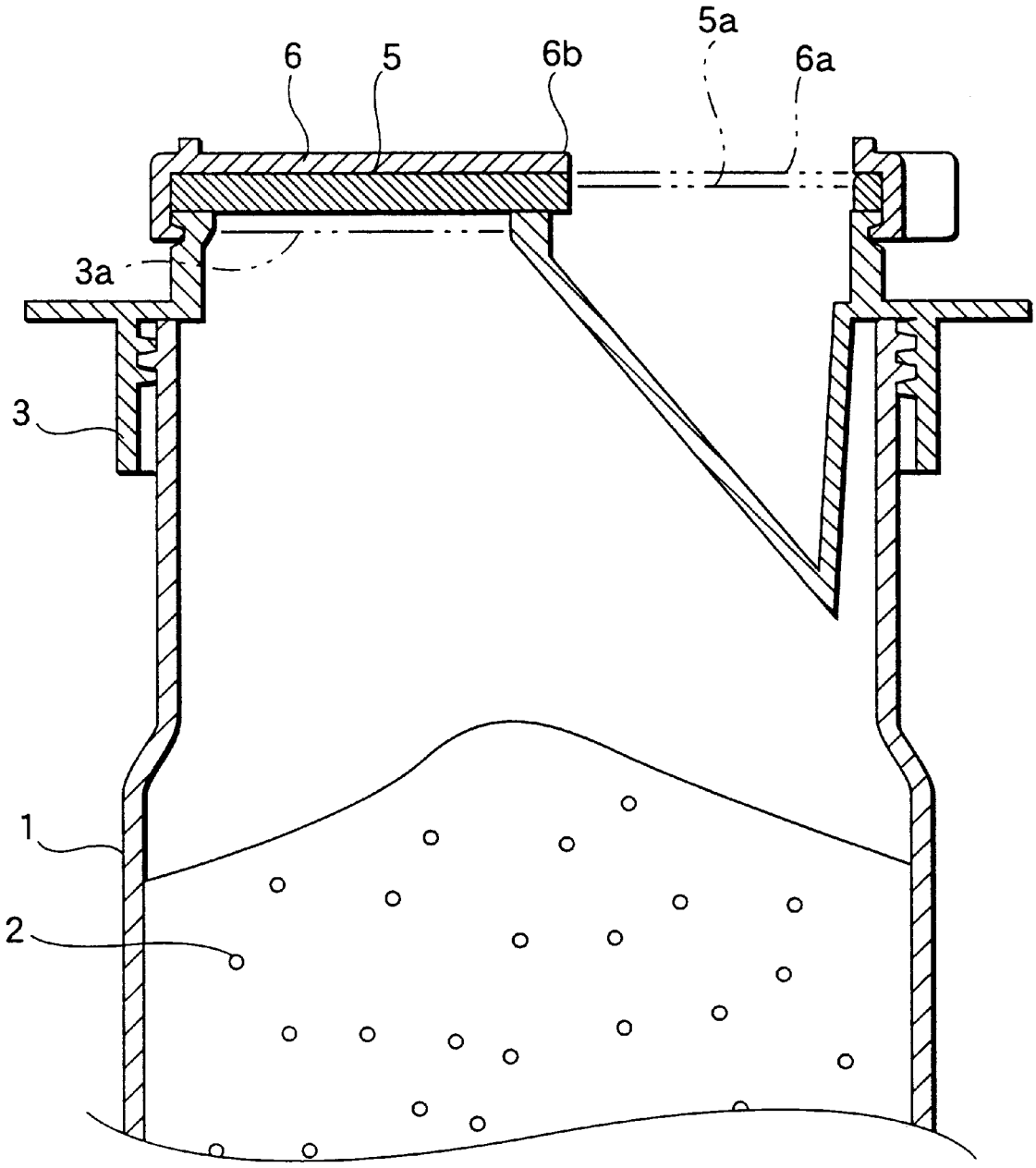
FIG.5 PRIOR ART
FIG. 5 is a side sectional view showing the conventional toner cartridge.
Figure 6:
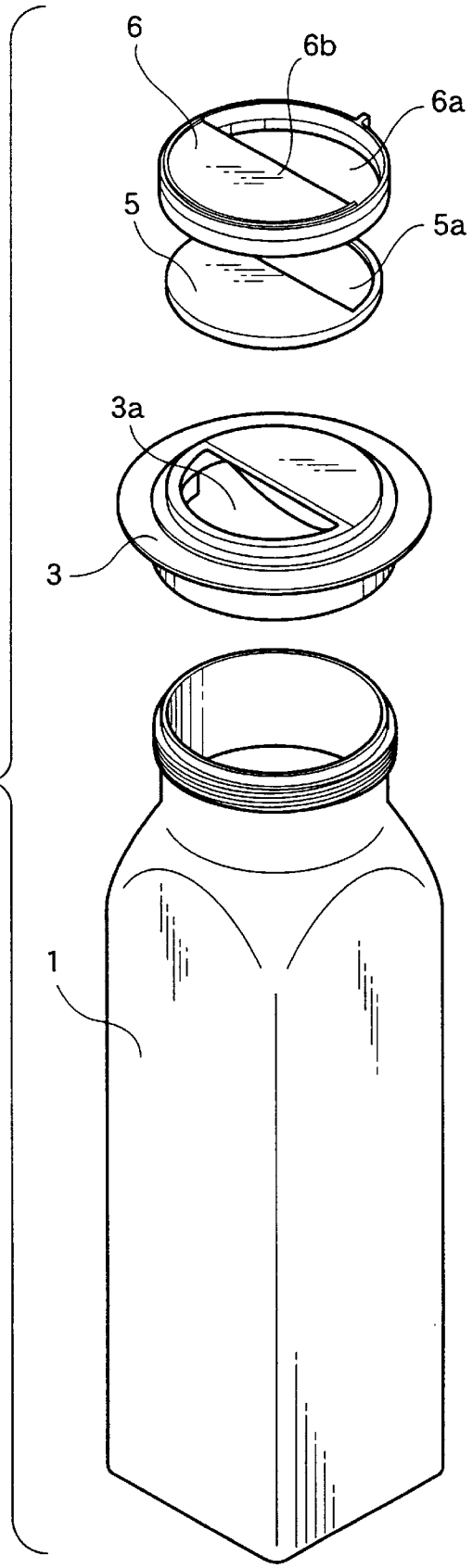
FIG.6 PRIOR ART
FIG. 6 is an oblique view of the conventional toner cartridge.
Figure 7:
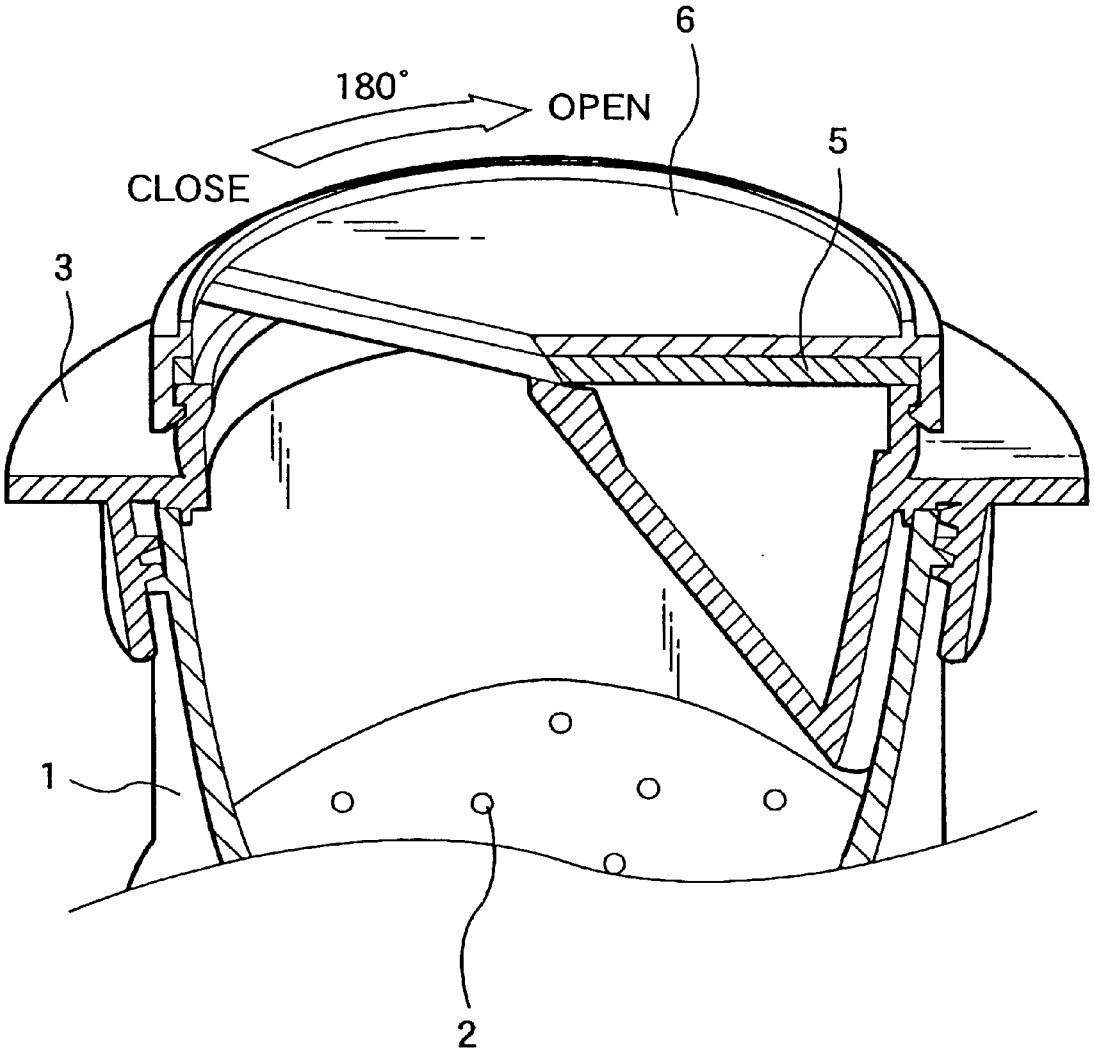
FIG.7 PRIOR ART
FIG. 7 is a sectional view showing an operation of the conventional toner cartridge.
Figure 8:
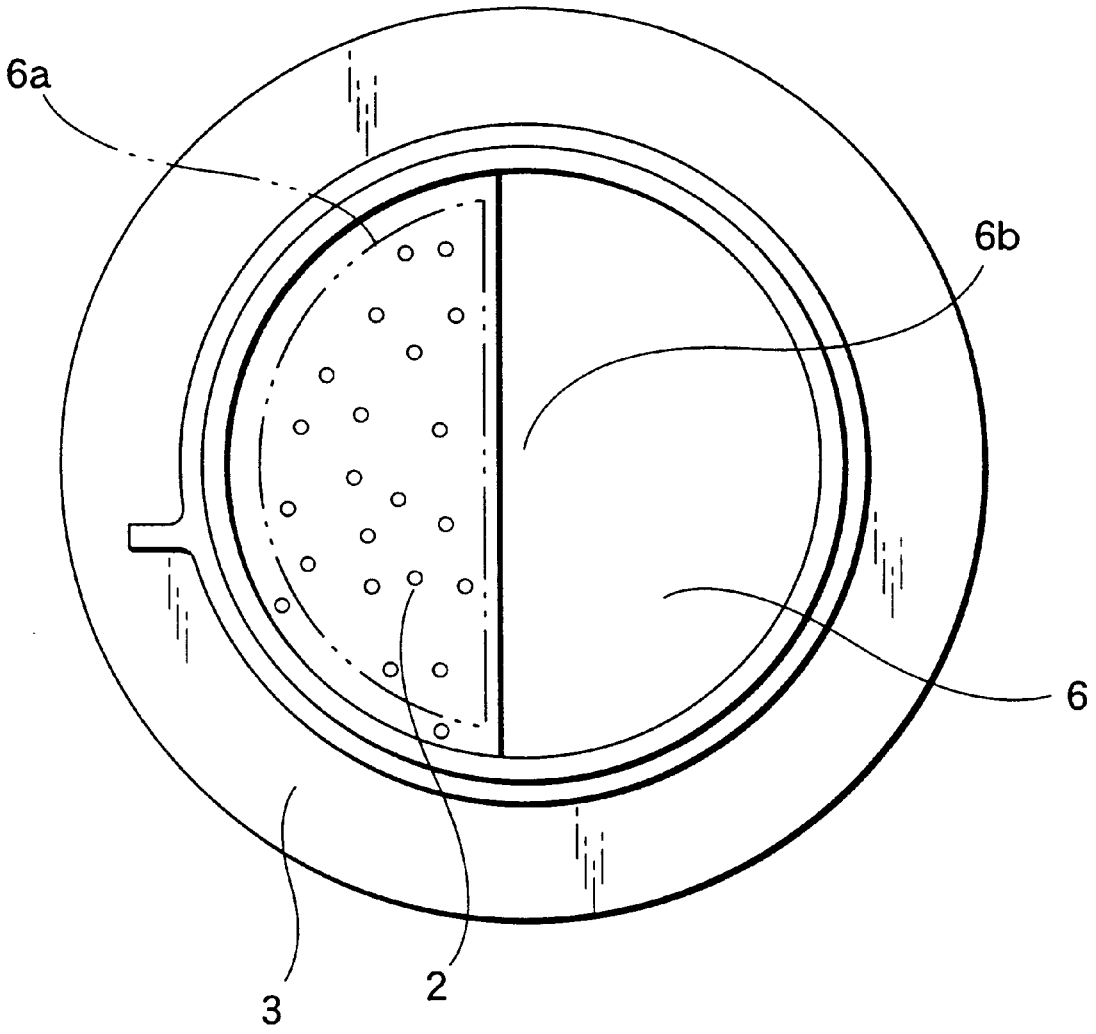
FIG.8 PRIOR ART
FIG. 8 is a top view of the conventional toner cartridge.
Figure 9:
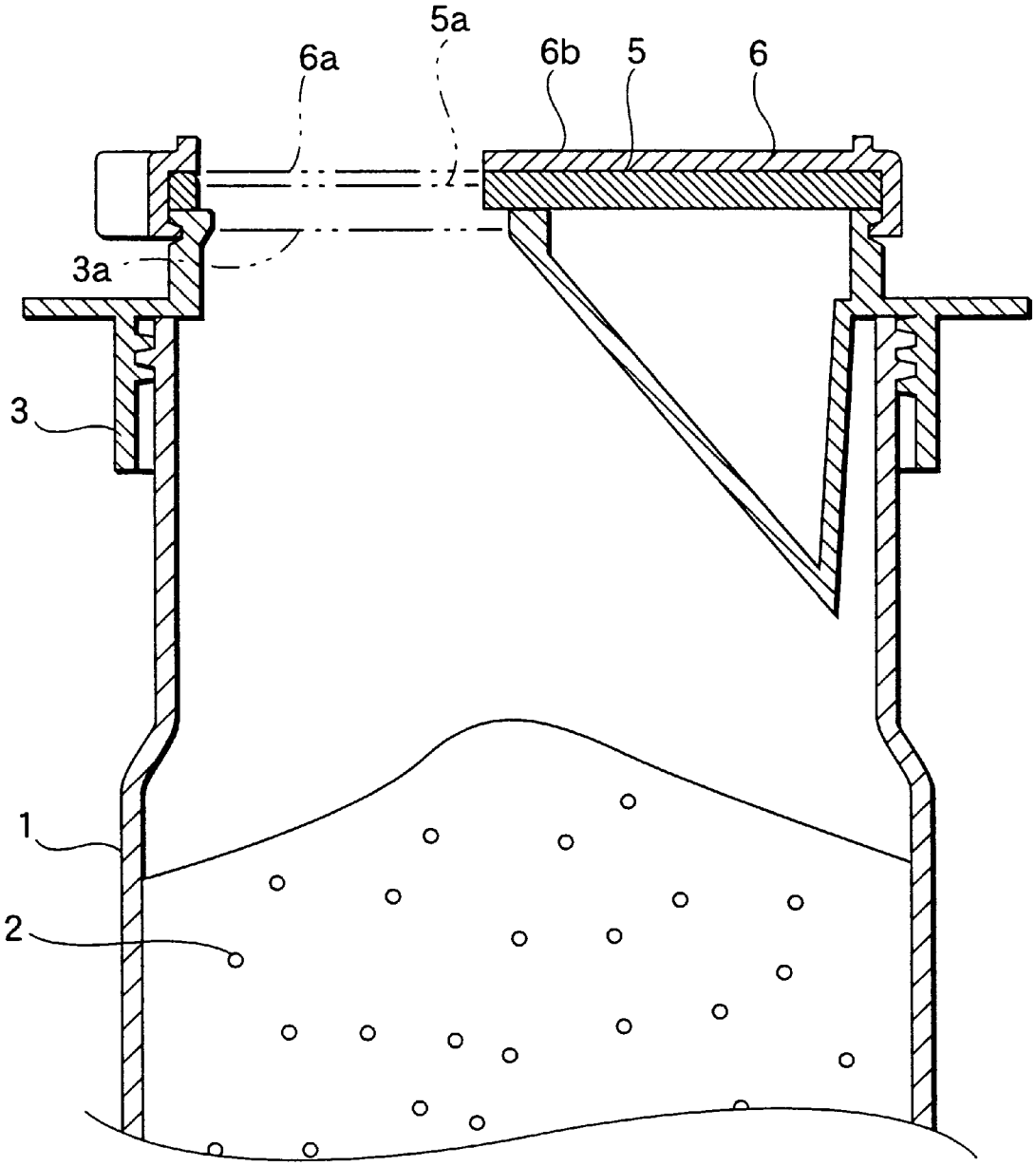
FIG.9 PRIOR ART
FIG. 9 is a side sectional view of the conventional toner cartridge.

In FIGS. 1–3, a toner cartridge of the present invention is shown. A reference numeral 1 denotes a container 1 for containing toner, which has an opening portion. A reference numeral 3 is a cap fixed to the opening portion of the container 1, and the cap 3 has a semicircle opening portion 3*a*.

A reference numeral 4 denotes a film heat-sealed, which covers and seals the semicircle opening portion 3*a* of the cap 3.

The film 4 is partly folded back to form a tab 4*a* to be pulled so that the film 4 can be peeled off from the cap 3.

A reference numeral 6 denotes a shutter rotatably disposed on the cap 3, and the shutter 6 has a semicircle opening portion 6*a* and a covering portion 6*b*. The semicircle opening portion 6*a* is substantially the same shape as the semicircle opening portion 3*a* of the cap 3. The covering portion 6*b* of the shutter 6 covers the opening portion 3*a* through the film 4 when the cartridge is not used.

A reference numeral 5 denotes a sponge 5 having a semicircle opening portion 5*a* which is substantially the same shape as the semicircle opening portion 3*a* of the cap 3. The sponge 5 is disposed between the cap 3 and the shutter 6. The sponge 5 is pressed by the shutter when the shutter 6 is attached to the cap 3, and rotates with the shutter 6.

When the cartridge is used to supply the toner to an image forming apparatus, the shutter 6 is rotated with the sponge

5 so that the opening portions 3*a*, 5*a* and 6*a* correspond to each other. Therefore, the toner can be supplied through the semicircle opening portion 3*a*, 5*a* and 6*a*.

In this embodiment, a volume of the container 1 is 3000 $cm^3$ and a diameter of the semicircle opening 6*a* is 80 mm. Until the film 4 is peeled off, the film 4 covers and protects the cap 3. After the film 4 is peeled off, the shutter 6 covers the semicircle opening portion 3*a* of the cap to prevent the toner from spilling out of the container 1.

According to the present invention, in the case the volume of the container is enlarged, the leaking of the toner hardly occurs when the cartridge is transported or stored. Therefore, the cartridge can be transported or stored using freer package conditions, which contributes to improvements of the distribution efficiency. Moreover, the increase of the amount of toner supplied at the same time increases the amount of the toner per a cost of the cartridge, so that the cost per a page can be reduced.

What is claimed is:

1. A toner cartridge comprising:

a container for containing toner of a volume of 2500 $cm^3$ or more, the container defining an opening portion;

a cap fixed to the opening portion of the container, the cap defining a first semicircle opening portion;

a film covering and sealing the first semicircle opening portion of the cap; and a shutter rotatably disposed on the cap, the shutter defining a second semicircle opening portion capable of corresponding to the first semicircle opening portion of the cap, and the shutter having a diameter of 70 mm or above.

2. The toner cartridge as claimed in claim 1, wherein the film is allowed to be peeled off from the cap with the shutter closed.

* * * * *